US005205764A

United States Patent [19]

Thiger

[11] Patent Number: 5,205,764

[45] Date of Patent: Apr. 27, 1993

[54] STEERING MECHANISM IN A BOAT PROPULSION SYSTEM

[75] Inventor: Hans Thiger, Enhörna, Sweden

[73] Assignee: CPS Drive A/S, Norway

[21] Appl. No.: 689,836

[22] PCT Filed: Oct. 25, 1989

[86] PCT No.: PCT/SE89/00592

§ 371 Date: May 28, 1991

§ 102(e) Date: May 28, 1991

[87] PCT Pub. No.: WO90/06256

PCT Pub. Date: Jun. 14, 1990

[30] Foreign Application Priority Data

Nov. 28, 1988 [SE] Sweden ..... 8804296-5

[51] Int. Cl.[5] ..... B63H 5/12

[52] U.S. Cl. ..... 440/58; 440/61; 440/79

[58] Field of Search ..... 440/53, 60, 61, 57, 440/58, 79

[56] References Cited

U.S. PATENT DOCUMENTS 4,358,280 11/1982 Jeanson et al. ..... 440/61

4,580,517 4/1986 Londberg ..... 440/53

*Primary Examiner*—Edwin L. Swinehart

*Attorney, Agent, or Firm*—Larson and Taylor

[57] ABSTRACT

A marine propulsion drive apparatus has an input drive shaft with a propeller shaft extending through the stern of the boat and a drive body extending substantially straight out the stern of the boat and having a propeller at the end thereof. Steering is accomplished by operating the drive body itself. The drive body and the stern of the boat have a common oblique upward rearward slope. The contact surface of the drive body is mounted rotatably about an axis which is perpendicular to the contact surface such that when the boat is turned in one direction or the other, the entire drive body with the propeller mechanism is rotated about that contact surface, such that the propeller mechanism at the outer end of the drive body both rotates in the horizontal plane and also dips successively downwards following the rotating movement of the drive body.

9 Claims, 5 Drawing Sheets

STEERING MECHANISM IN A BOAT PROPULSION SYSTEM

FIELD OF THE INVENTION

The present invention generally relates to a marine propulsion system, generally referred to as a vessel or boat drive, for use in water vehicles having an inboard engine and of the type in which the drive system with the propeller shaft extends through the stern of the boat, substantially straight out therefrom and is enclosed in a drive body, and in which the propeller shaft has, at the outer end thereof, a propeller, preferably of the surface drive type, and in which the steering of the boat is done by operating the drive body itselt. The invention is more particularly concerned with a new type of steering mechanism for such a marine drive system.

BACKGROUND OF THE INVENTION

A boat drive of this type is known from U.S. Pat. No. 4,645,463 (H M Arneson) which patent discloses a structure in which the drive body is formed with a ball over which the drive is connected to the drive engine which is mounted inside the boat, and in which said ball is journalled in a ball carrier which is mounted at the stern of the boat, and in which the apparatus comprises two external hydraulic cylinders interconnecting the stern of the boat and a part of the drive for rotating the drive in the horizontal plane for the purpose of turning the boat, and in which there is an additional hydraulic cylinder for making it possible to trim (tilt) the drive by rotating the drive up or down in the vertical direction about the point of rotation of the said ball.

A boat drive of this type having a water surface driving propeller is highly advantageous as compared with the so called Z-drive types, and above all the drive causes less flow losses and less power losses depending on existing angle gear drives and transmission gear sets. Depending on the simple structure of the drive it is also cheaper to manufacture, more effective and apt to less wear and has less sources of error than many other types of boat propulsion drives.

The apparatus known from U.S. Pat. No. 4,645,463 indeed includes the advantages of a drive being a straight, surface water driving propulsion drive, but it is disadvantageous in that the ball and the ball carrier are subjected to strong stresses; in that certain plays may appear in the steering means thereof and in that the hydraulic cylinders for the trimming (tilting) and for the steering operations need to be serviced and maintained, are subjected to wear and are sensitive to ruptures and leakage in the hydraulic conduits, in particular since said parts are located on the exterior side of the boat, behind the stern of the boat. Normally there is also a need for long conduits and/or hoses from the propulsion drive at the outside of the boat to the maneuvre place inside the vessel or boat.

SUMMARY OF THE INVENTION

Therefore, the object of the present invention is to suggest a propulsion drive for an inboard-outboard motor of the type in which the drive has a surface driving propeller which extends through the stern of the boat and substantially straight back therefrom, and in which the propulsion drive is formed

- so that the boat can be steered without the assistance of hydraulic cylinders or equivalent axial power motors placed on the exterior side of the boat,
- in which the propulsion drive has no actuation means at all provided on the exterior side of the boat whether for trimming the drive or for steering the boat,
- in which both the trimming and the steering of the drive is made by means of actuation means placed inside the complete drive structure and at the interior side of the boat or vessel hull,
- and which has an improved back driving capacity as compared with previously known systems of the same general type.

BRIEF DESCRIPTION OF THE DRAWINGS

Further characteristics and advantages of the invention will be evident from the following detailed description in which reference will be made to the accompanying drawings.

In the drawings

DETAILED DESCRIPTION OF THE PREFERRED EMBODIMENTS

Figure 1:
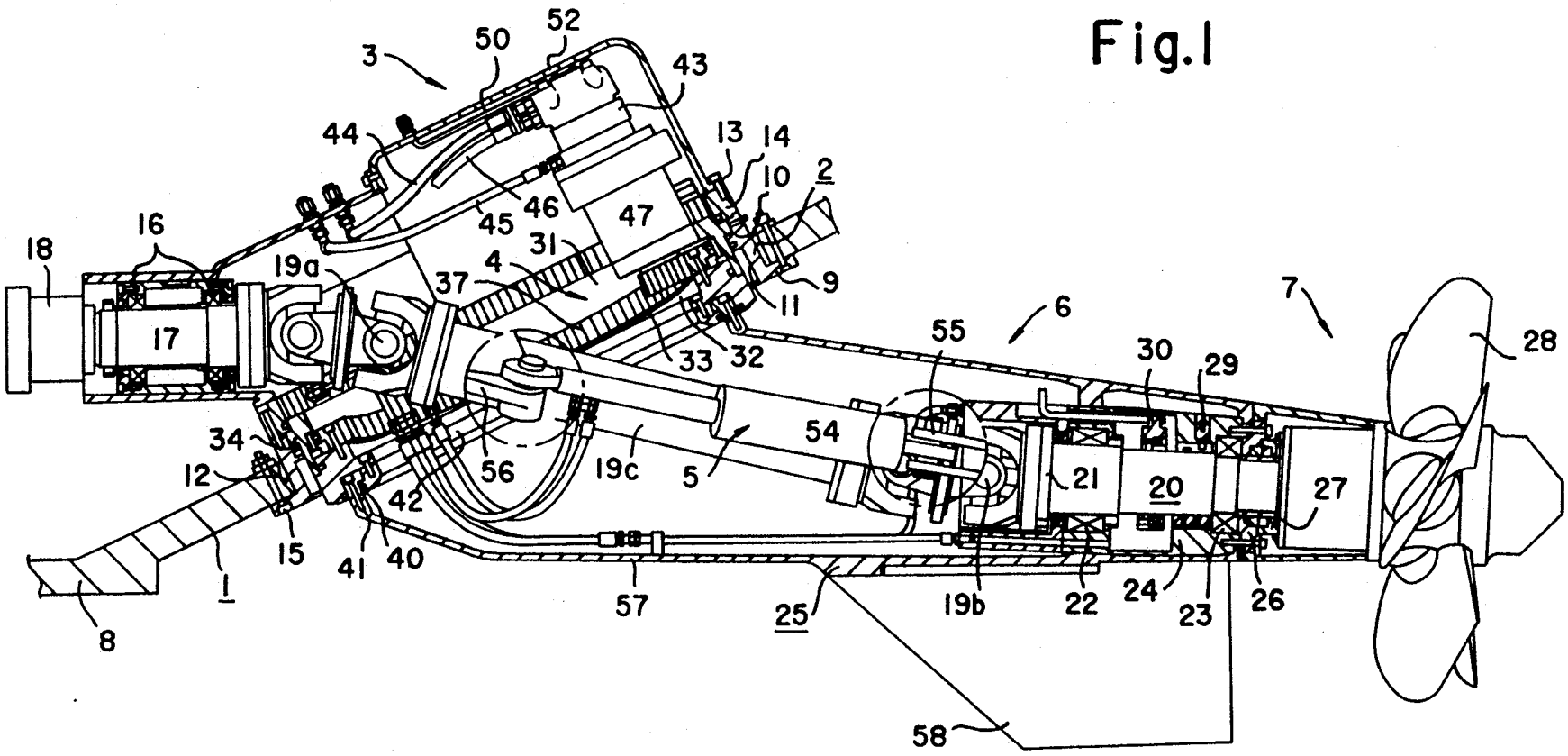
FIG. 1 is a side view in a vertical cross section of an embodiment of a propulsion drive according to the invention.

For the sake of clarity the inboard boat engine has been omitted, but it should be noted that the engine may be directly or indirectly connected to the propulsion drive by any known means, and that drive coupling between the engine and the propulsion drive may be of any known type and does not influence the invention.

As conventional the propulsion drive according to the invention extends through the stern 1 of a boat or a vessel and is mounted on said stern by means of a mounting ring 2. The drive generally comprises a mounting or bearing body 3 provided at the interior side of the boat hull, a trimming or tilting mechanism 4, a steering mechanism 5, a drive body 6 and a propeller mechanism 7.

The drive is mounted close to the bottom 8 of the boat. The boat should be of the fast running and preferably planing type. For obtaining the best function of the invention the stern should be rather long, sloping rearwardly, for instance sloping at an angle of between 20° and 40°, or preferably between 22° and 30°. In the case illustrated in the drawings the stern has a pitch angle of 25° to the horizontal plane. Because of the unusually long sloping stern there is obtained, when adjusting the propellers for rearward driving, a forwardly directed flow of water which smoothly follows the shape of the stern rather than being thrown against the stern, which would in turn reduce the back driving capacity, such as is usual for boats having a more steep to vertical extending stern. Therefore the apparatus of the invention has an improved back driving capacity.

The mounting ring 2 is formed with a radially outwardly extending outer flange 9 and a radially inwardly extending inner flange 10 and with a sleeve portion 11 between said flanges 9 and 10. The outer flange 9 is arranged to be mounted on the exterior side of the stern 1, and the inner flange 10 with the sleeve portion 11 is adapted to carry the entire drive body 6.

For the purpose of mounting the drive on the stern a bore, preferably a circular bore 12, is cut out of the stern 1, and into said bore the mounting ring 2 is introduced with the flange 9 thereof in contact with the outer surface of the stern around said bore 12. On the inner side of the stern there are several screw-nut connection means, and an all around extending flange 13 of the bearing body 3 is connected to the mounting ring 2 over a connection ring 14, and the entire structure is screwed to the stern under water sealed conditions by means of bolts 15.

The bearing body 3 is formed as a closed, water sealed casing which, over a double ball bearing 16 and an intermediate slide box 17 for the input drive shaft 18, is connected to an inboard engine (not illustrated). The end of the input drive shaft 18 is formed with an intermediate drive shaft comprising two spaced universal joints 19*a* and 19*b* and an intermediate sleeve 19*c*, which intermediate drive shaft 19*a–c* gives a constant angle speed and eliminates un-even torque and thrust in the transmission joints. The ball bearing/slide box 16–17 which is of known type, allows an axial movement of the combined drive coupling.

Figure 2A:
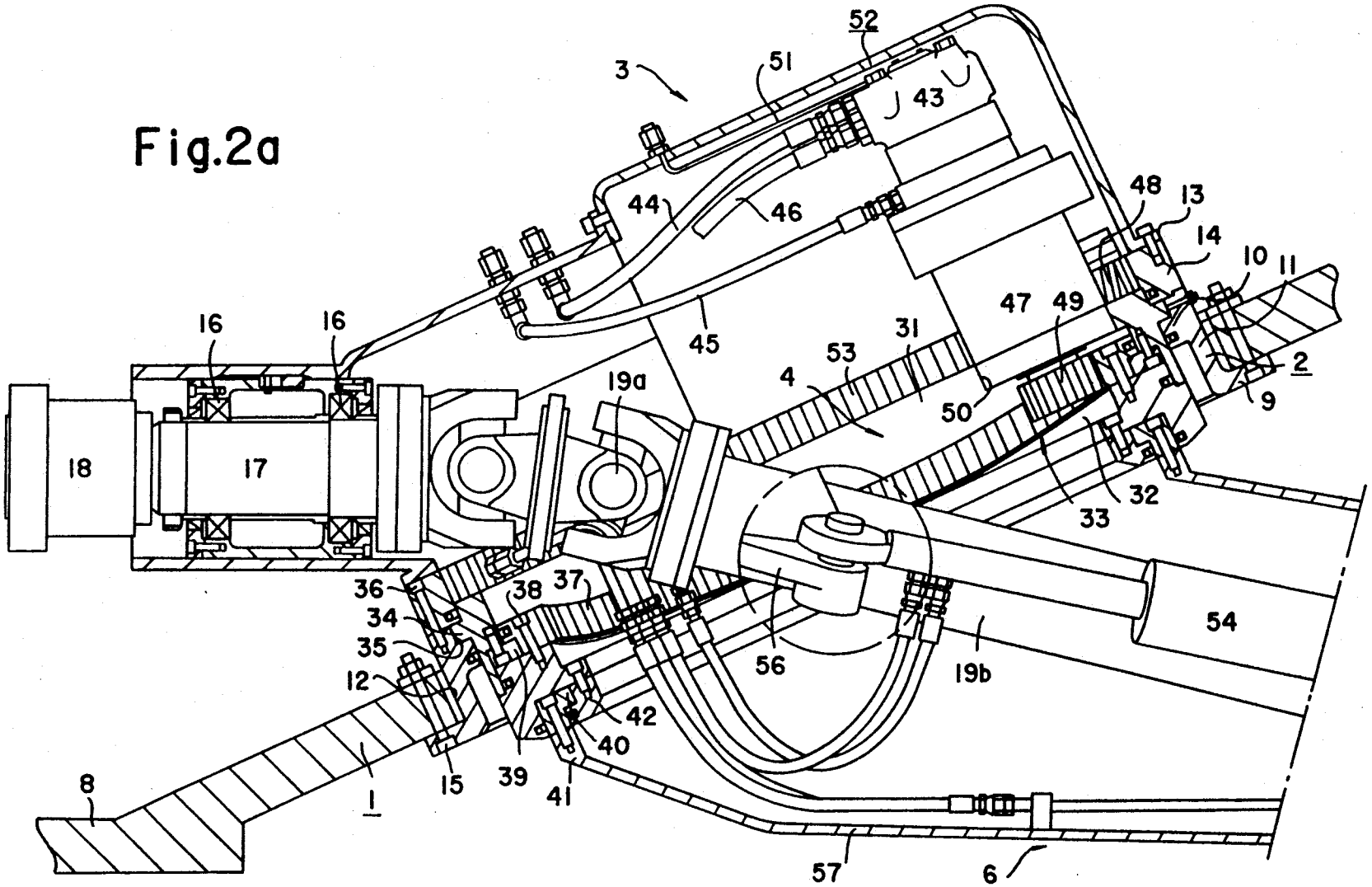
FIGS. 2*a* and 2*b* are in combination an enlarged view of FIG. 1.
Figure 2B:
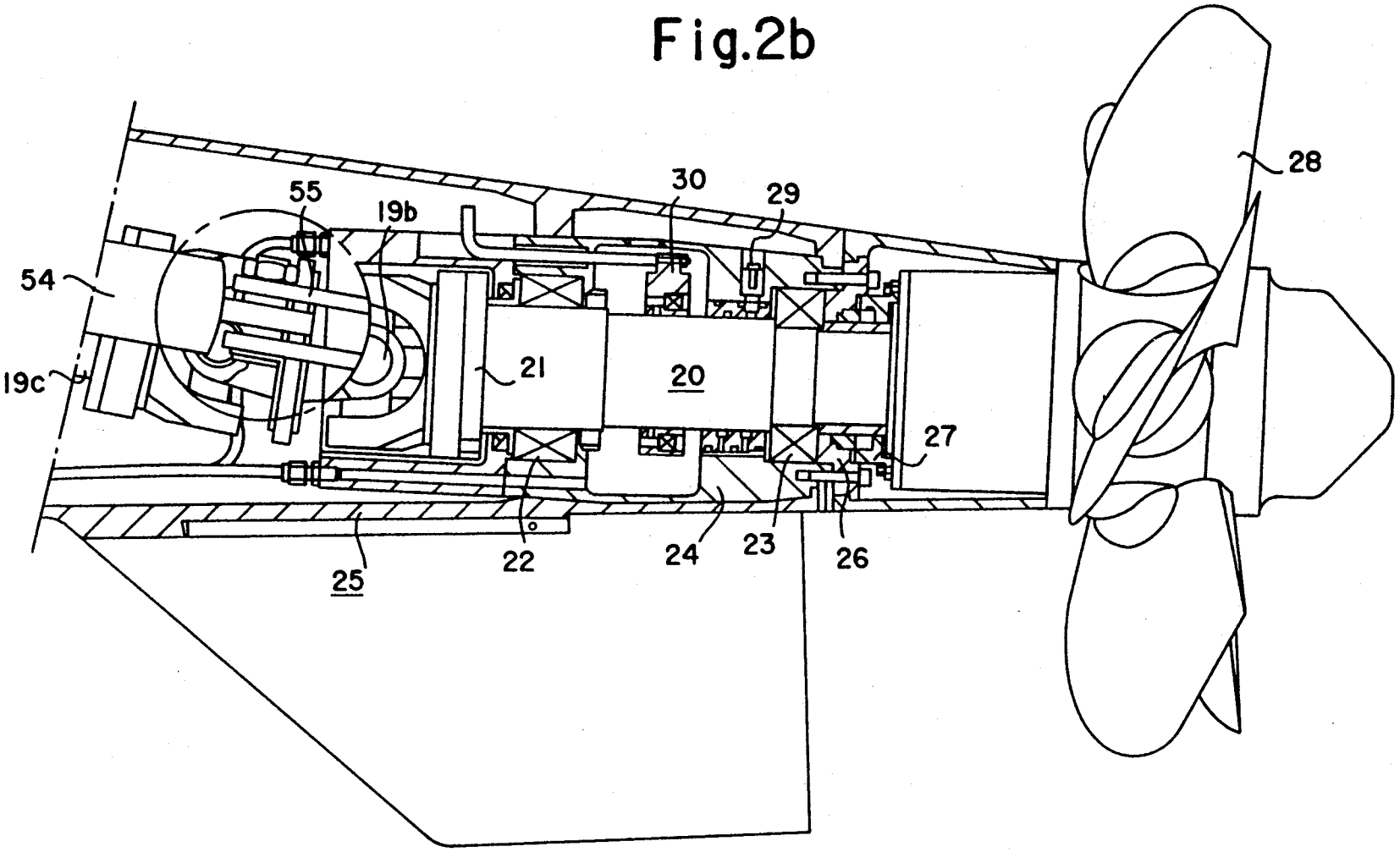

As best seen from FIG. 2*b* a propeller shaft 20 is connected to the output end of the rear universal joint 19*b* by a flange 21 thereof. The propeller shaft 20 is journalled in the drive body 6 over two spaced roller bearings 22 and 23, which roller bearings 22 and 23 are mounted in a bearing sleeve 24 which in turn is fixedly mounted at the end of the drive body housing 25 via a screw connected locking ring 26, such that the propeller shaft 20 can take pressure forces, both in the forward and rearward directions thereof. A seal 27 at the end of the propeller shaft 20 prevents water from entering the drive body 6.

The propeller mechanism 7 is of known type and is therefore not described in detail. The propeller or the propellers preferably are formed with propeller blades 28 of variable pitch type and which can be adjusted to various angles so that said propeller blades, by being angle-adjusted, can be set into forward or rearward propulsion or an idle drive positions. The adjustment of the propeller blades is made by means hydraulic pressure fluid entering the propeller shaft 20 and passageways (not illustrated) in the propeller shaft through one or more hydraulic valves 29. The set position of the propeller blades is transferred to the maneuvre place by means of an indicator 30.

The trim mechanism 4 and the steering mechanism 5 are formed as an integral unit which is connected between the mounting body 3 and the drive body 6. The trim mechanism is screw connected to the mounting ring 2 by means of the connection ring 14.

Referring in particular to FIG. 2*a* the trim mechanism 4 generally comprises two co-operating adjustment rings, referred to below as the first or inner adjustment ring 31 and the second or outer adjustment ring 32. The surfaces 33 of said rings 31, 32 facing each other are inclined. In the illustrated case the two adjustment rings 31 and 32 have an indentation angle of about 10°, whereby the drive body 6 can be tilted or trimmed 10° up, see FIG. 4, or 10° down, see FIG. 5, from a neutral position, FIG. 3, but it is obvious that the conicity may be varied with respect to the desired capability of "trimming" the drive up and down, resp. The two rings 31 and 32 are rotatable in relation to each other and in relation both to the mounting ring 2 and to the drive body 6. The adjustment rings 31 and 32 are mounted so that, in the neutral positions of the rings, the thinnest and the thickest ring portions, resp. are in contact with each other. The inner ring 31 is formed with a radially outwardly extending collar 34 by means of which it is rotatably clamped between the connection ring 14 and a collar surface 35 at the inner flange 10 of the mounting ring 2, and for the purpose the connection ring 14 is screw connected at 36 to the mounting ring 2. At the top of the second ring 32 an inner rack ring 37 is screw connected at 38 and the second ring 32 with the rack ring 37 is rotatably clamped to the first or inner ring 31 by means of a locking ring 39 which is screw connected to said inner ring 31. A guide ring 40 is rotatably mounted in a recess at the bottom surface of the second ring 32 and said guide ring is screw connected to the end surface or guide surface 41 of the drive body 6. The guide ring 40 with the drive body 6 is rotatably clamped to the second ring 32 by means of a locking ring 42 which is screw connected to the second ring 32.

Thus the inner ring 31 is rotatable in relation to the mounting ring 2, to the connection ring 14 and to the second ring 32; and the second ring 32 with the rack ring 37 is rotatable in relation to the first ring 31; and the drive body 6 with the guide ring 40 is rotatable in relation to the outer or second ring 32.

The trimming of the drive body up or down is made by rotating the two adjustment rings 31 and 32 in opposite directions from a neutral trim position. See FIGS. 3–5. To this end the apparatus is formed with a hydraulic motor 43 which is supplied with pressure fluid over conduits 44 and 45 and is drained by a third conduit 46. The hydraulic motor is combined with a gear box 47 having a first and a second gear 48 and 49. The hydraulic motor 43 with the gear box 47 is mounted in a recess 50 in the first ring 31 for rotation in common with said first ring 31. The motor 43 is maintained at a fixed radius by a rotation rod 51 which is mounted at the top of the housing 52 of the mounting body 3 concentrically with the rings 1 and 32.

The connection ring 14 is formed with an inner, ring-formed rack 53, which rack is thereby stationarily mounted in relation to the mounting body 3. The gear 48 of the hydraulic motor 43 is cooperates with the stationary inner ring rack 53, and by actuating the hydraulic motor 43 and thereby rotating the gear 48 the motor with the gear box 47 rotates in one direction or the other on the stationary inner rack 53. Thereby also the first or inner ring 31 is rotated together with the motor 43. The gear 49 of the hydraulic motor 43 cooperates with the inner gear 37 of the second ring 32 and it is arranged to rotate the second ring 32 in a direction which is opposite to the movement of the first ring 31 and at a speed which is the same as the speed of the first ring 31. This means that the gear 49 rotates at twice the speed of the gear 48.

Figure 3:
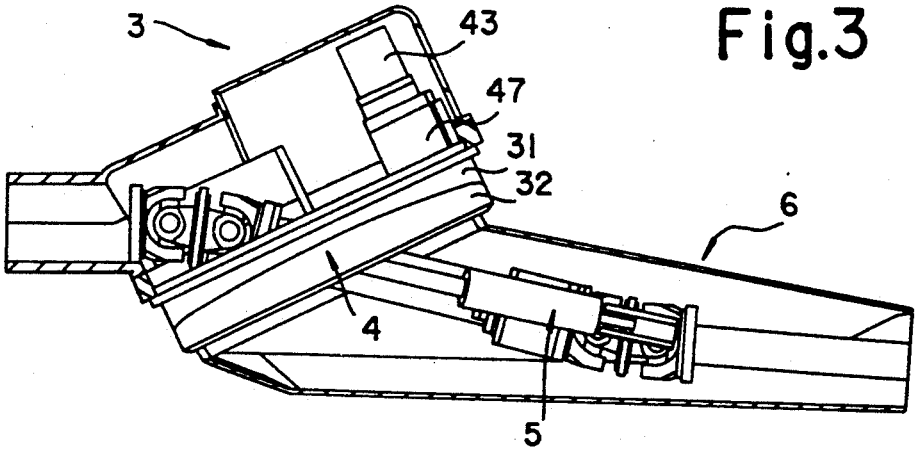
FIG. 3 is a fragmentary vertical cross section through a drive according to the invention in its neutral trim position.
Figure 4:
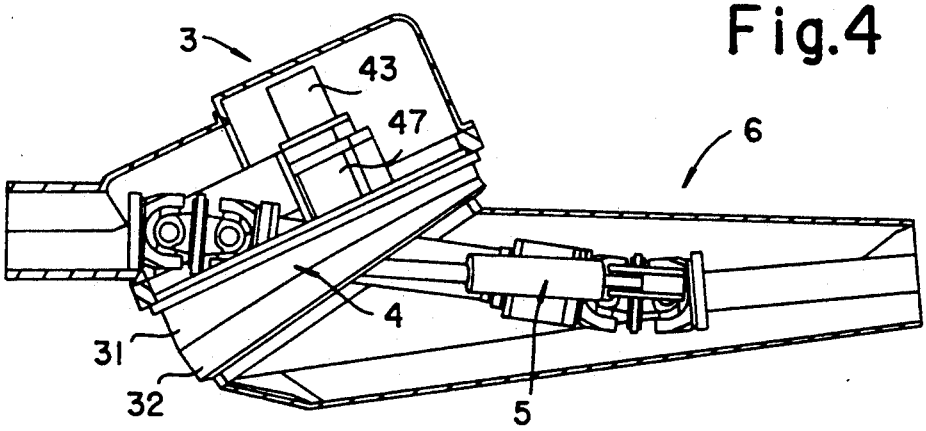
FIG. 4 is view similar to that of FIG. 3 showing the drive trimmed up a maximum angle and FIG. 5 similarly shows the drive trimmed down a maximum angle.
Figure 5:
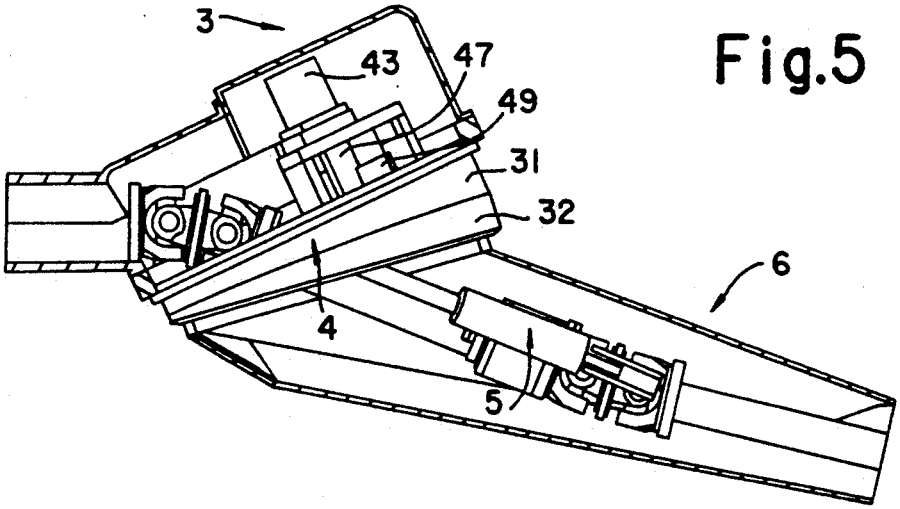
Figure 6:
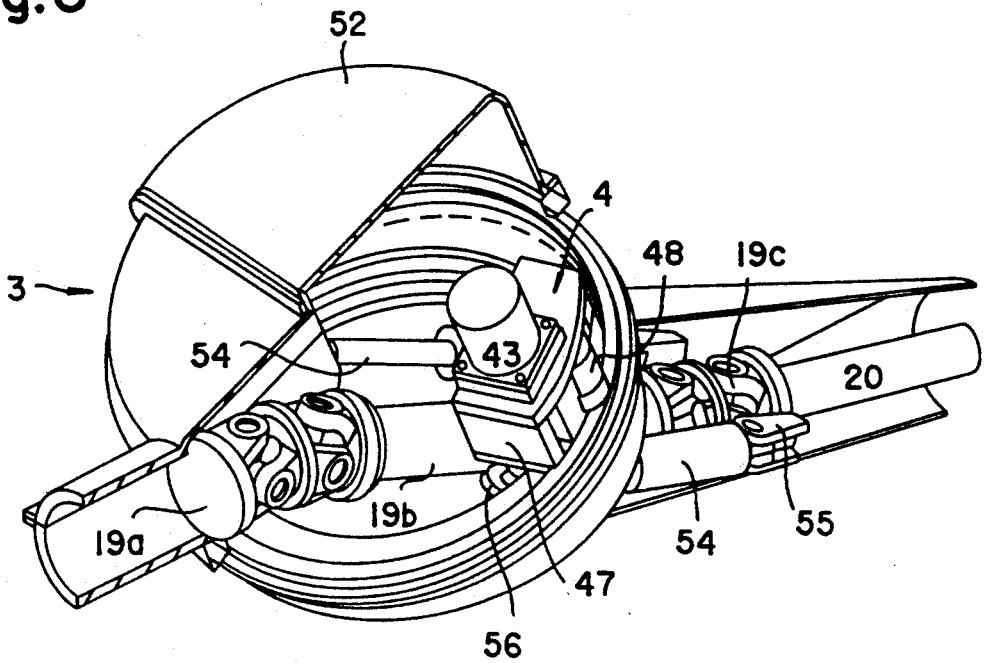
FIG. 6 is a fragmentary perspective view of a part of the drive showing the trimming motor and the mounting of the steering cylinders.
Figure 7:
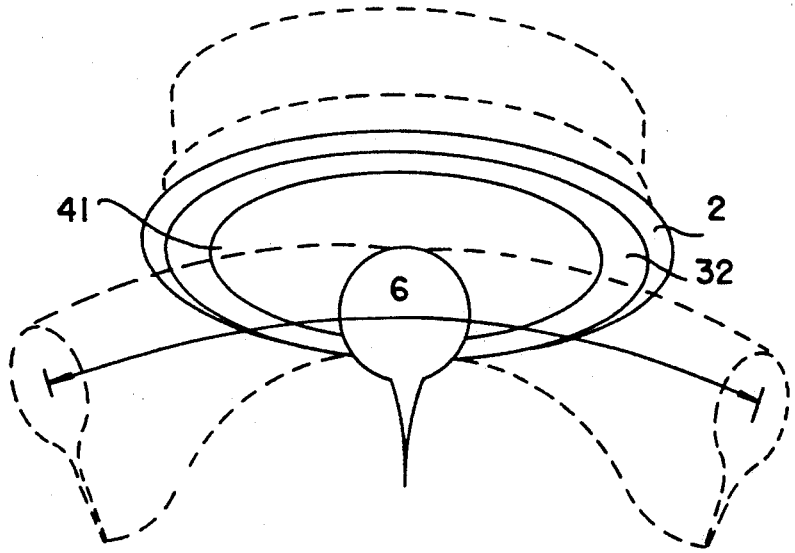
FIG. 7 is a diagrammatical rear view of the drive according to the invention showing the movement of the propeller or propellers when turning the boat in one direction or the other.

By actuating the hydraulic motor 43 the gear 48 engaging the stationary rack ring 53 causes the motor 43 to rotate on said rack ring 53, and thereby the first or inner ring 31, on which the motor 43 is mounted, is also rotated in one direction or the other in relation to the mounting body 3, and concurrently therewith the gear 49 rotates the second ring 32 in the opposite direction and with twice the gear speed, whereby different adjustment ring combinations are obtained. FIG. 3 shows the apparatus in a neutral position, whereby the motor 43 is located at the top end of the mounting body 3 and the thickest and thinnest portions of the rings 31 and 32, resp. contact each other. By rotating the motor 43 with the second ring 32 in one direction (counter clockwise as seen from inside the boat) as illustrated in FIG. 4 of the drawings the thickest portions of the two rings 31 and 32 contact each other at the bottom portion of the mounting body 3 and the thinnest portions of the two rings 31 and 32 contact each other at the top end of the mounting body 3, and in this case the drive body is trimmed maximum upwards, in the illustrated case at an angle of 10° from the neutral position. FIG. 5 illustrates the apparatus after the hydraulic motor 43 is operated in the opposite direction (the clockwise direction as seen from inside the boat) whereby the drive body is trimmed maximum downwards, in the illustrated case 10° downwards.

The end face or guide end 41 of the drive body 6 is circular and said end of the drive body is rotatably mounted in a groove of the second ring 32 of the trim mechanism 4. For rotating the drive body 6 in relation to the mounting body 3, thereby turning the boat in the starboard or port direction, there is a hydraulic cylinder 54 mounted inside the drive body 6 on each side of the sleeve 19c and the propeller shaft 20. Each hydraulic cylinder 54 is mounted with the cylinder part thereof in an ear 55 which is fixedly connected to the bearing sleeve 24; and with the piston rod part thereof in an ear 56 which is fixedly mounted in the housing 52 of the mounting body 3.

Since the hydraulic cylinders 54 extend at a specific angle to the slide surface at the drive body guide end 41 and the second ring 32 an actuation of the hydraulic cylinders introduces a rotary force between the drive body 6 and the mounting body 3 which force causes the drive body to rotate with the end 41 thereof in the slide groove of the second ring 32, and thereby in relation to the mounting body 3.

Since further the connection surface of the mounting body 3 at the stern 1 of the boat is designed so as to form a certain angle to the vertical plane, the propeller or propellers at the outer end of the drive body 6 is/are caused to make a double movement upon a steering function, namely both a rotating movement in the horizontal plane, causing the boat to turn, and also a dipping of the propeller(s) in the vertical direction, said double movement resulting in a tendency of the boat to turn vertically inwardly to the turning centre, just as happens upon turning with a bicycle. Said turn-over movement inwardly to the turning center is a valuable function which both contributes to a stabilizing of the boat and also eliminates the feeling of discomfort which will otherwise appear, something that is especially noted in catamarans, hydrofoil boats, boats having a high center of gravity, etc.

Normally the propulsion drive takes a predetermined horizontal driving position which is, in the illustrated case, at an angle to the horizontal plane of for instance four degrees, at which position there is a fully laminar flow of water from the bottom 8 of the boat and past the bottom side 57 of the drive body 6 and also the other parts of the drive is fully laminar. Therefore there are practically no flow losses, not even at high speeds. Considering the load and speed etc. of the boat, or by driving the boat in shallow water it may be desired to trim the drive up (or down) and this is done by rotating the trim drive motor 43, whereby the racks 53 and 37 cause a rotation of the inner and outer rings 31 and 32 in opposite directions so that the inclined surfaces 33 of said rings take a changed mutual position, whereby the drive is successively tilted up or down (compare FIGS. 3–5) depending on in what direction the motor 43 is rotated. This change of trim position can very well be made while running the boat and it is made without any influence at all on the steering function.

The steering is made solely by rotating the drive end or guide head 41 by actuating the steering cylinders 54, whereby the drive body 6 is both rotated in the horizontal direction and is dipped successively downwards in the vertical direction in relation to the mounting body and the stern of the boat, and whereby the boat is also successively turned vertically in the direction towards the turning center of the boat.

| Reference numerals | |
|---|---|
| 1 stern | 31 inner adjustment ring |
| 2 mounting ring | 32 outer adjustment ring |
| 3 mounting body | 33 cone surface |
| 4 trimming mechanism | 34 collar (of 31) |
| 5 steering mechanism | 35 collar surface |
| 6 drive body | 36 screw |
| 7 propeller mechanism | 37 inner rack ring (of 32) |
| 8 bottom (of boat) | 38 screw |
| 9 outer flange (of 2) | 39 locking ring |
| 10 inner flange (of 2) | 40 guide ring |
| 11 sleeve portion (of 2) | 41 end surface, guide ring |
| 12 bore (of 1) | 42 locking ring |
| 13 flange (of 3) | 43 hydraulic motor |
| 14 connection ring | 44 conduit |
| 15 bolt | 45 conduit |
| 16 ball bearing | 46 drain conduit |
| 17 slide box | 47 gear box |
| 18 input shaft | 48 gear |
| 19a universal joint | 49 gear |
| 19b universal joint | 50 recess |
| 19c sleeve | 51 rotation rod |
| 20 propeller shaft | 52 housing (3) |
| 21 flange | 53 inner rack ring |
| 22 roller bearing | 54 hydraulic cylinder |
| 23 roller bearing | 55 ear (at 24) |
| 24 bearing sleeve | 56 ear (at 3) |
| 25 drive body housing | 57 bottom (of 6) |
| 26 locking ring | |
| 27 seal | |
| 28 propeller blade | |
| 29 hydraulic valve | |
| 30 indicator | |

I claim:

1. A marine propulsion drive apparatus for an inboard engine in which the input drive shaft with its propeller shaft extends generally horizontally through the stern of a boat, comprising:

a drive body extending generally horizontally substantially straight out from the stern of the boat and having a propeller attached to the drive body and extending generally axially and horizontally at the outer end thereof, said propeller arranged and designed to operate at the water surface, and wherein steering of the boat is accomplished by operating the drive body itself, a common connection surface of the drive body and the stern of the boat having an obliquely upwards-rearwards slope from the bottom of the boat, the connection surface of the drive body at the stern of the boat being rotatably mounted about an axis which is perpendicular to said connection surface, whereby the boat is turned by rotating the entire drive body in one direction or the other about said connection surface.

2. An apparatus according to claim 1, wherein said contact surface of the drive body is circular.

3. An apparatus according to claim 1, wherein the rotatable connection surface of the drive body is mounted such that the propeller at the outer end thereof, upon rotation of the drive body about said axis and turning of the boat, both rotates in a horizontal plane and moves vertically downwardly by an amount which is related to the extent of the horizontal rotating movement.

4. An apparatus according to claim 1, wherein the connection surface lies at an angle of 20° to 40° relative to a horizontal plane.

5. An apparatus according to claim 4, wherein the angle of the connection surface relative to a horizontal plane is between 22° and 30°.

6. An apparatus according to claim 1, wherein the drive body is mounted such that the propeller shaft, during running of the boat, normally forms an angle of between 3° to 6° relative to a horizontal plane, and wherein said angle can be trimmed successively upwardly and downwardly from said normal angle a maximum of approximately 10°.

7. An apparatus according to claim 1, including a steering mechanism which is operationally connected to a trimming mechanism, which trimming mechanism comprises two cooperating adjustment rings having surfaces which are inclined relative to their respective bases, which bases are parallel to each other, the inclined surfaces being in direct contact with each other, an outer one of said adjustment rings carrying the drive body, the two adjustment rings being rotatable relative to each other to allow different adjustment ring combinations for trimming the drive body upwardly or downwardly, respectively.

8. An apparatus according to claim 7, wherein the steering mechanism and the trimming mechanism are actuable independently of each other.

9. An apparatus according to claim 1, wherein the steering mechanism comprises two hydraulic cylinders which are mounted inside of the drive body on each side of a drive shaft, said hydraulic cylinders being connected at one end to the drive body and at their other ends to a stationary housing of the apparatus.

* * * * *